United States Patent [19]

Hamy

[11] Patent Number: 4,852,273

[45] Date of Patent: Aug. 1, 1989

[54] SOLE ARRANGEMENT FOR FOOTWARE

[75] Inventor: Norbert Hamy, Toronto, Canada

[73] Assignee: Bata Limited, Toronto, Canada

[21] Appl. No.: 192,205

[22] Filed: May 9, 1988

[30] Foreign Application Priority Data

May 21, 1987 [CH] Switzerland ..... 965/87
Aug. 28, 1987 [CH] Switzerland ..... 321/87

[51] Int. Cl.[4] ..... A43B 13/18

[52] U.S. Cl. ..... 36/28; 36/25 R; 36/59 C; 36/32 R

[58] Field of Search ..... 36/25 R, 28, 29, 31, 36/32 R, 59 C, 59 R, 71, 91; D2/320

[56] References Cited

U.S. PATENT DOCUMENTS 2,353,829 7/1944 Jakosky ..... 36/25 R
4,268,980 5/1981 Gudas ..... 36/71
4,638,577 1/1987 Riggs ..... 36/28
4,724,624 2/1988 Duclos ..... 36/59 R

FOREIGN PATENT DOCUMENTS 745089 7/1970 Belgium ..... 36/32 R
0049019 4/1982 European Pat. Off. ..... 36/25 R
19548 7/1982 United Kingdom ..... 36/25 R
2099283 12/1982 United Kingdom ..... 36/25 R

*Primary Examiner*—Werner H. Schroeder
*Assistant Examiner*—D. Biefeld
*Attorney, Agent, or Firm*—Helfgott & Karas

[57] ABSTRACT

A sole arrangement for footwear or the like comprises an insole and an outsole. On the side of the outsole which faces the bearing surface, the insole is provided with a support system comprising a plurality of webs and channels and which is substantially arranged in the metatarsal region. The tread surface of the outsole which faces the ground has two web-like profile parts and a flat support part and is subdivided into individual support regions which are separated from one another substantially by a recess oriented in the longitudinal direction of the tread surface and are provided with channels and webs arranged approximately at right angles to a longitudinal axis of the sole arrangement.

15 Claims, 4 Drawing Sheets

FIG. 2
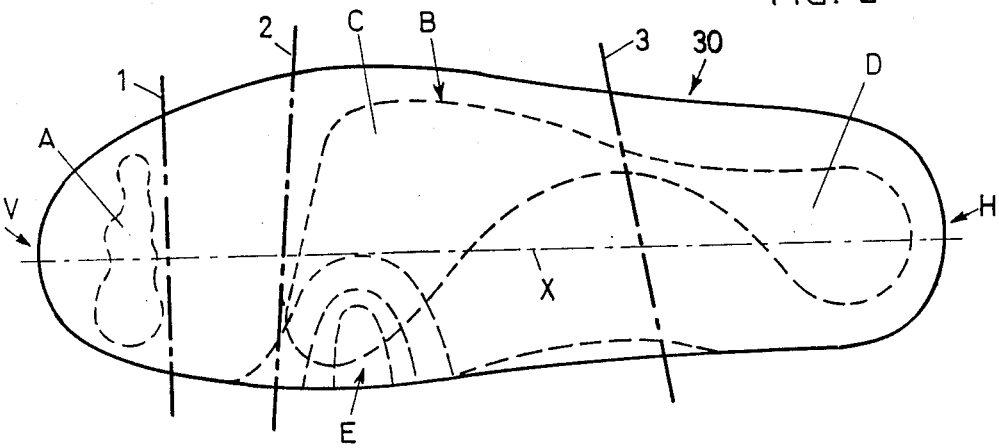
FIG. 3
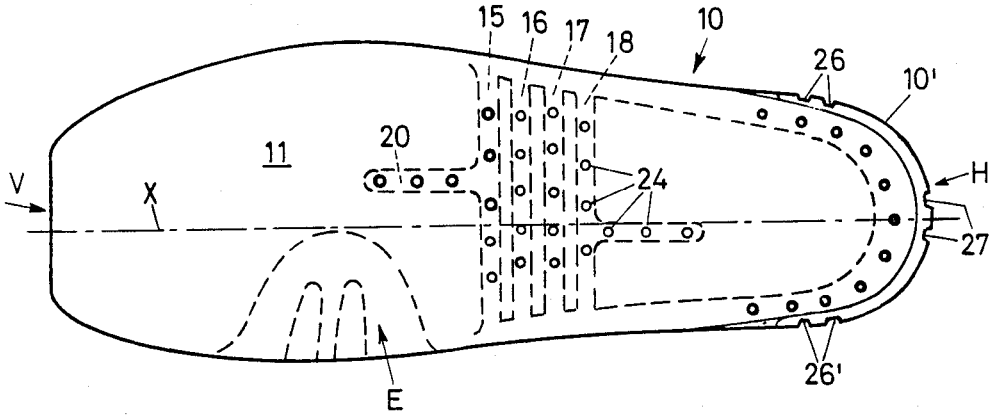
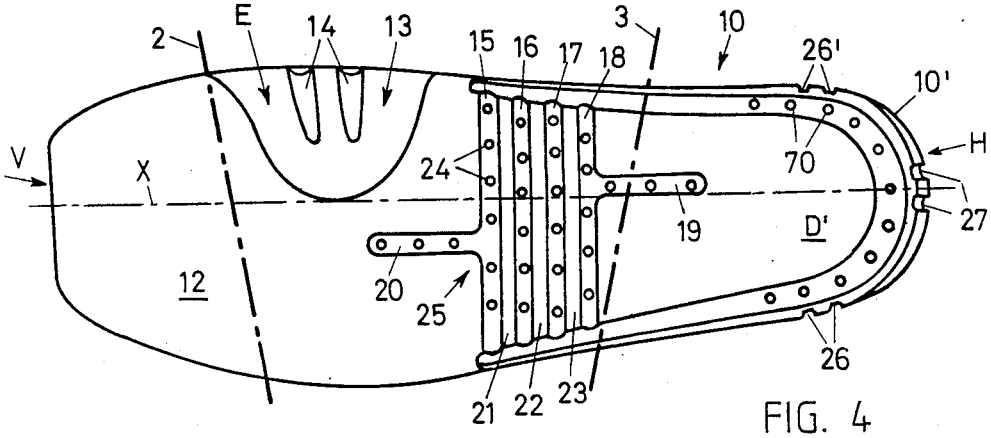
FIG. 4

FIG. 6
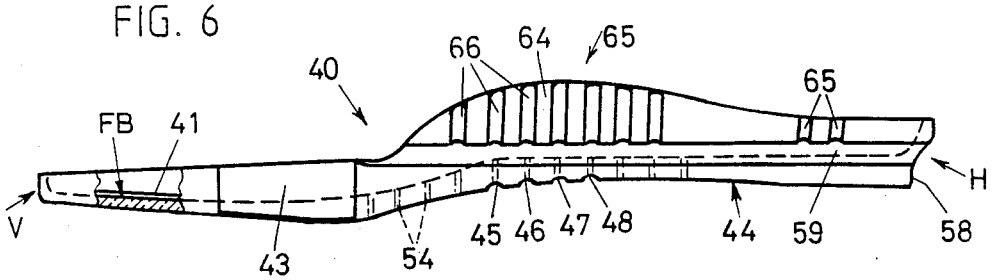
FIG. 7
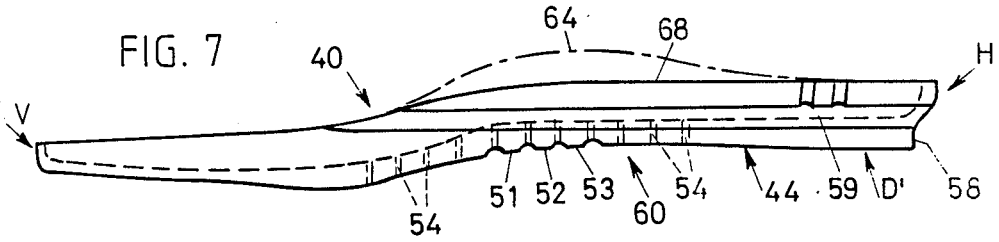
FIG. 8
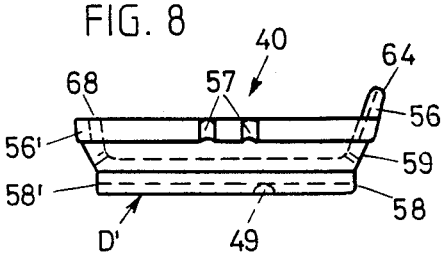
FIG. 9
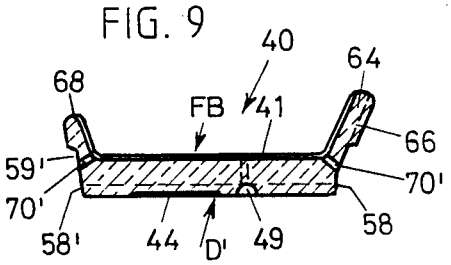
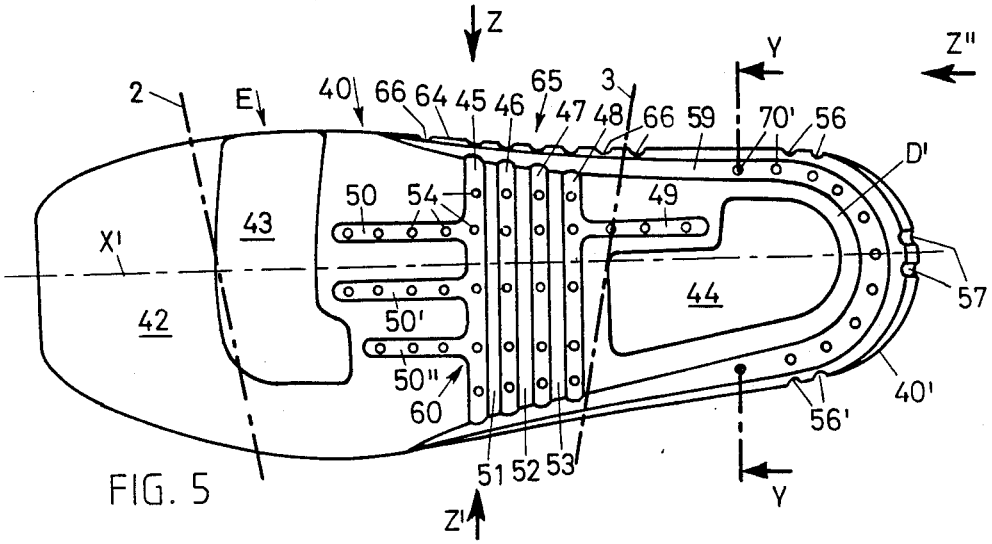
FIG. 5

SOLE ARRANGEMENT FOR FOOTWARE

BACKGROUND OF THE INVENTION

The invention relates to a sole arrangement for footwear or the like comprising an insole constructed for the natural support of the human foot, as well as an outsole operatively connected therewith.

In the case of the human body, when standing, walking or running the entire load is borne by the two feet, which with respect to the load to be carried have a relatively small, bridge-like support surface (plantar arch). As a function of the loading and movement type, the individual foot areas and, via the associated muscles, the active locomotor system and simultaneously the corresponding circulatory organs of the human body are subject to different loading.

For an advantageous, natural support of the foot corresponding to the anatomy of the human body and the complete locomotor system (feet, legs, etc.), a shoe, boot or the like is needed which, inter alia, is provided with a breathing-active insole constructed in accordance with the load and movement requirements.

SUMMARY OF THE INVENTION

It is an object of the invention to provide a new sole arrangement for footwear which ensures an optimum support of the foot not prejudicial to the physiological coordinated movement.

In accordance with the principles of the invention:

(a) the insole is provided on an outer bearing surface facing the outsole with a support system having a plurality of webs and channels, (b) the outsole has an inner bearing surface for the insole and on the tread surface facing the ground is provided with a first web-like profile part on the sole outside and a second web-like profile part on the sole inside, as well as a flat support part arranged in the toe region on the sole outside spaced from the first profile part and (c) the first profile part at a distance from the sole rear edge and the second profile part at a distance from the sole front edge is in each case located up to at least the centre of the complete sole length.

Further appropriate developments and features of the invention can be gathered from the following description in conjunction with the drawings and claims.

BRIEF DESCRIPTION OF THE DRAWINGS

The invention is described hereinafter relative to the drawings, wherein:

FIG. 2 is a diagram of a shoe sole in plan view.

FIG. 3 is a plan view of the inner surface of an inside facing the foot.

FIG. 4 is a plan view of the outer surface of the insole according to FIG. 3 remote from the foot.

FIG. 5 illustrates a variant of the outer surface of the insole in plan view.

FIG. 6 illustrates an insole shown in elevation in accordance with the direction of arrow Z in FIG. 5.

FIG. 7 illustrates an insole shown in elevation in the direction of arrow Z' in FIG. 5.

FIG. 8 illustrates an insole shown in side view in accordance with the direction of arrow Z'' in FIG. 5.

FIG. 9 is a section through the insole along line Y—Y in FIG. 5.

DETAILED DESCRIPTION OF PREFERRED EMBODIMENTS

Figure 1:
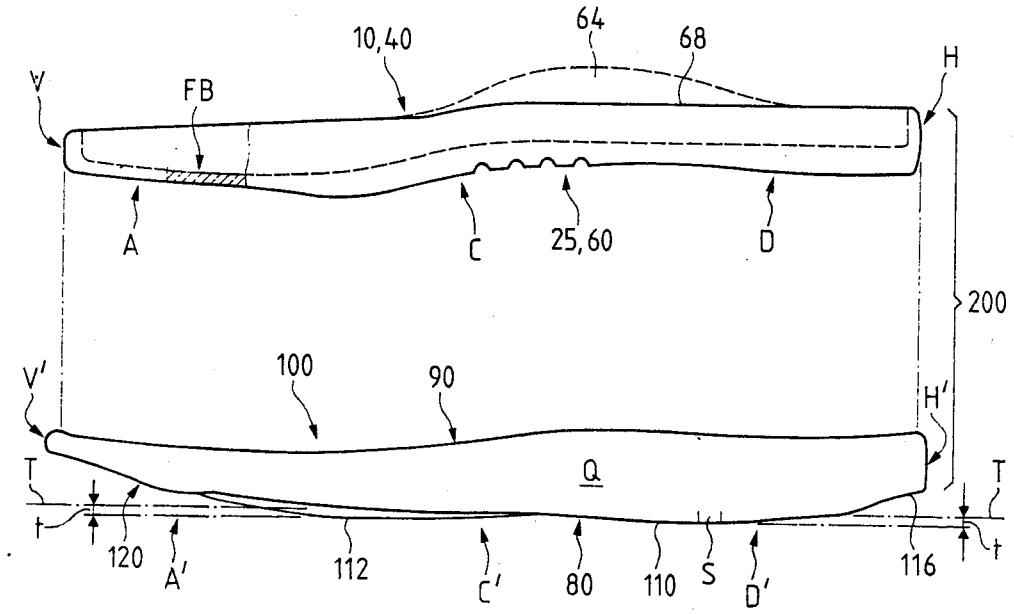
FIG. 1 is a diagrammatically represented sole arrangement in the form of an exploding drawing.

FIG. 1 diagrammatically shows a sole arrangement 200 in an exploded view for a not shown shoe, boot or the like, said sole arrangement essentially comprising an insole 10 or 40 and an outsole 100.

In connection with the insole 10 or 40, V is the front edge, H the rear edge and FB a part sectionally represented foot bed. It is also possible to see on the top of the sole a foot bed wall 64 and 68 and on the bottom of the sole a support system 25 or 60, as well as loading portions indicated by arrow directions A, C and D, as correspond to an impression of a not shown, human foot and which will be subsequently described in detail.

In connection with the outsole 200, V' is the front edge, H' the rear edge, 90 the bearing surface facing the insole 10, 40 and 80 an outer bearing surface or tread surface facing the ground or floor. It is also possible to see loading portions indicated by arrow directions A', C' and D', and these will be subsequently explained.

In a general view, FIG. 2 diagrammatically shows in plan view the inner surface of a shoe sole 30 facing a not shown foot, e.g. the right foot and it is possible to see the loading portions A and B, whose outer contour is represented in broken line manner, as correspond to the impression or support system of a human foot. Portion A largely corresponds to the bearing profile of the toes and portion B essentially to the profile of the foot which is a function of the bearing pressure, portion B comprising a metatarsal area designated C, a tarsal area designated D and on the inside of the foot a support or foot ball area (capitulum of the first metatarsal bone) of the metatarsus designated E. FIG. 2 also shows by means of dot-dash lines 1, 2, 3 oriented substantially at right angles to a longitudinal axis X of the shoe sole 30, important portions which, starting from the front edge of the sole designated E correspond up to line 1 to the front toe phalanxes (phalanx II), from line 1 to 2 the central toe phalanxes (phalanx I), from lines 2 to 3 essentially the central area (metatarsus) of the foot and from line 3 to the rear edge designated H the tarsal area (tarsus) of the foot.

FIG. 3 shows in plan view as a first embodiment a correspondingly constructed inner surface 11 facing a not shown foot, e.g. the right foot, whilst FIG. 4 is a plan view of an outer surface 12 remote from the foot of the inventive insole 10 constructed as a so-called support body. As is apparent from this embodiment on the outer surface 12 (bottom of the sole) is provided the support system 25 which, in the vicinity of the metatarsus, comprises between lines 2 and 3 a plurality of channels 15, 16, 17 and 18 oriented substantially at right angles to longitudinal axis 6 and separated from one another by rib-like webs 21, 22 and 23, as well as channels 19 and 20 oriented parallel to the longitudinal axis X. In the individual channels 15 to 20 are provided a plurality of spaced holes 24 which, emanating from the outer surface 12 or the individual channel 15 to 20 extend up to the inner surface 11 (FIG. 3) and consequently penetrate the insole 10. The channels 15 to 18 with the associated rib-like webs 21 and 23 preferably extend over the entire width of the insole profile 10 and together form a breathing-active profile arrangement corresponding to the loads and movements which occur.

Between lines 2 and 3 of the metatarsal area is provided, as shown in FIGS. 3 and 4, in the support ball region E a diagrammatically represented pocket 13, which has two spaced cams 14, oriented approximately at right angles to longitudinal axis X and preferably constructed as damping elements.

In the heel region of insole 10, i.e. between line 3 and rear edge H are provided, as shown in FIGS. 3 and 4, on the outer circumferential edge 10, on either side of the longitudinal axis X and on the rear edge H, slot-like channels 26, 26' and 27, channels 26 and 26' preferably equidistantly facing one another on the circumferential edge 10' and are approximately oriented at right angles to the longitudinal axis X and to the rear edge H.

FIG. 5 shows as a second embodiment the insole 40 and it is possible to see the outer surface 42 remote from the foot, a support system 60 provided in the vicinity of the metatarsus between lines 2 and 3 and which has a plurality of channels 45, 46, 47 and 48 oriented approximately at right angles to longitudinal axis X' and separated from one another by webs 51, 52 and 53, as well as channels 49, 50, 50' and 50" oriented approximately parallel to longitudinal axis X'. In the individual channels 45 to 50, 50' and 50" are provided a plurality of spaced holes 54, which approximately vertically penetrate the body of insole 40. Channels 45 to 48 with the associated webs 51 to 53 essentially extend at right angles to the longitudinal axis X' over the entire width of the shoe sole 40. Channels 50, 50' and 50" are arranged approximately parallel to longitudinal axis X' and are spaced parallel from one another. A further channel system 65 formed from several channels 66 and corresponding to the channels 45 to 48 is provided on the outside of the foot bed wall 64.

The same construction as for the first embodiment according to FIG. 4 is provided with the second embodiment according to FIG. 5, whereby correspondingly constructed, spaced channels 56, 56' and 57 are provided on the outer circumferential edge 40' of insole 40 on either side of longitudinal axis X' and on the rear edge H.

Diverging from the first embodiment, in the case of the second embodiment according to FIG. 5 in the support ball region E, as well as in the tarsal or heel region D is provided in each case one support element 43 or 44, which is preferably terminated flush with the lower edge of the sole, as diagrammatically represented in FIG. 9. When using the insole 40 as a so-called shoe insert, the two support elements 43 and 44 also serve to prevent the shoe slipping and consequently have a correspondingly constructed surface.

FIG. 6 diagrammatically shows the insole 40 represented in profile in a view in accordance with arrow direction Z in FIG. 5 and it is possible to see the foot bed wall 64, the channel system 65 formed from the individual channel 66, positioned laterally and integrated into wall 64, as well as the corresponding channels 45 to 48 arranged on the not shown bottom. It is also possible to see in the front, partly cut away portion, the foot bed FB extending in not shown manner from front edge V to rear edge H and a foot bed insert 41 fixed in foot bed FB.

FIG. 7 shows insole 40 in arrow direction Z' in FIG. 5 and it is possible to see the outer foot bed wall 68, which is somewhat lower, i.e. has a smaller height than the inner foot bed wall 64 shown here in dot-dash line manner. It is also possible to see the support system 60 formed from channels 45 to 48 and webs 51 to 53.

FIGS. 8 and 9 shows the insole 40 in a rear view corresponding to arrow direction Z" and in profile cross-section according to line Y—Y in FIG. 5 and it can be seen that the bearing surface of the tarsus designated D', which is bounded by lateral walls 58, 58' oriented substantially at right angles thereto, as well as by downwardly sloping and preferably shaped-on walls 59, 59'. As shown in FIGS. 7 and 8, the walls 59, 59' are penetrated by spaced holes 70' which consequently constitute a connection from the outside of the insole to foot bed FB.

It is pointed out at this point that the individual insole 10 according to FIGS. 3 and 4 constructed as a support body for the foot and the insole 40 according to FIG. 5 are preferably shaped and produced from foamed plastic as an integral moulding.

In order to obtain an optimum support of the human foot corresponding substantially to all possible load types, the insole 10 or 40 can be operatively connected with the correspondingly constructed, profiled outsold 100. The individual elements can then form a sole arrangement 200 formed from the insole and the outsole and which in not shown manner is preferably constructed as a standard component.

Figure 10:
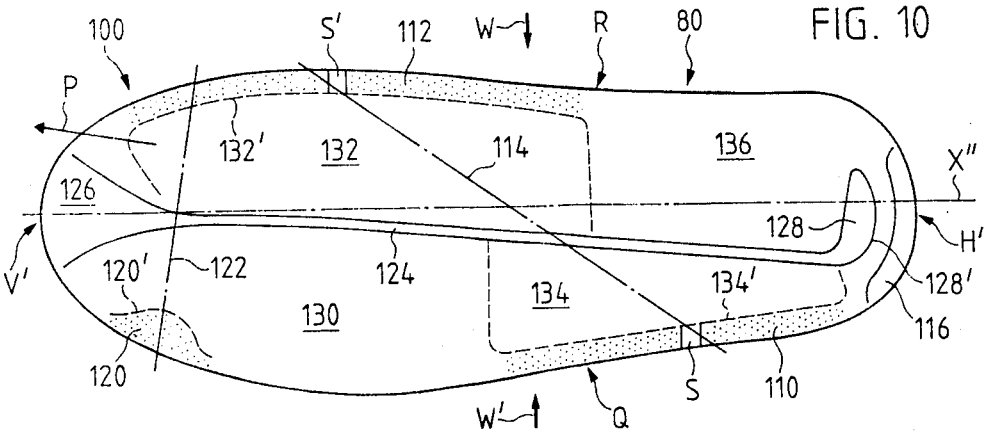
FIG. 10 is a plan view of a first constructional variant of a tread surface for an outsole facing the ground.

FIG. 10 shows a first constructional variant of outsole 100 in plan view and it is possible to see on the tread or bearing surface 80 a slot or channel-like recess 124 extending substantially from the front edge V' roughly to the rear edge H' and which issues in the vicinity of the front edge V' into a roughly fork-like opening 126 widening towards said front edge and in the vicinity of rear edge H' into a recess 128. With respect to a longitudinal axis X", recess 124 preferably forms an acute angle and is arranged between longitudinal axis X" and a sole outside Q.

The recess 128 provided with an arcuate edge 128' on the side facing the rear edge H' is positioned roughly at right angles to the longitudinal axis X" of outsole 100, one end of the recess 128 being closed and the other end, as already stated, issuing into the longitudinally oriented recess 124. In parallel spacing to the arcuate edge 128' of recess 128 is provided a heel bevel or taper 116 on the rear edge H' and this extends roughly at right angles to longitudinal axis X" over part of the here not shown heel of the tarsus.

The tread surface 80 is subdivided into so-called support regions 130, 132, 134 and 136, the support region 132 roughly bounded by the broken line 132' is provided on the sole inside R with a profile part 112, whilst the support region 134 roughly bounded by the broken line 134' is provided in the sole outside Q with a profile part 110. Profile parts 110, 112 arranged on the tread surface 80 have in cross-section a not shown convex shape directed towards the ground and in each case, considered in the direction of longitudinal axis X', extend over the centre of the total length L of the tread surface 80 so that, as shown in FIG. 10, in the central sole area there is a partial overlap of the two profile parts 110, 112 which are spaced with respect to the longitudinal axis X".

Roughly in the centre of the first profile part 110 is provided a first recess S and roughly in the centre of the second profile part 112 a second recess S', recesses S and S' being arranged in such a way that a theoretical line 114 linking the two recesses S, S' and oriented roughly at right angles to longitudinal axis X" approximately represents the axis of the subtalar coordinated movement performed by the human foot when supported on the ground and moves roughly in arrow direction P (FIG. 10) of the big toe from the first contact taking place roughly on the outside of the heel bevel 116.

A further theoretical line 122 shown in FIG. 10 roughly corresponds to the bearing profile of the toes designated A in FIG. 2. In the vicinity of the not shown small toe a flat support part 120 is provided on tread surface 80 and is roughly bounded by broken line 120' with respect to the support region 130 and is provided and constructed for supporting the toes during the rolling movement bending the toes.

Figure 11:
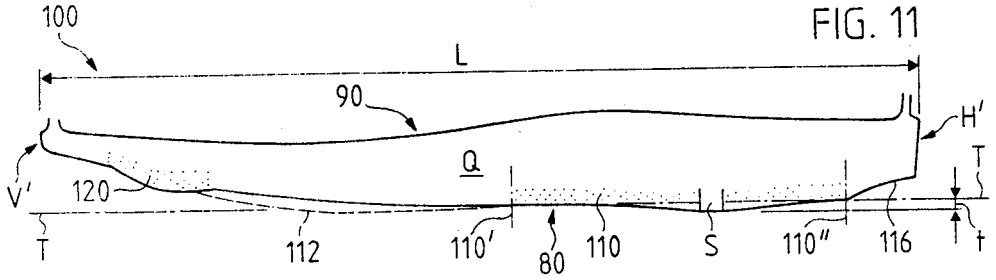
FIG. 11 illustrates the outsole shown in a perspective view in accordance with arrow direction W in FIG. 10.

FIG. 11 shows in a view in arrow direction W' (FIG. 10) the sole outside Q of the outsole 100 shown diagrammatically and in profile. It is possible to see the bearing surface 90 facing insole 10, 40, the tread surface 80 facing the ground and represented here by the dot-dash line T—T, the support part 120, the heel bevel 116 and the profile part 110 arranged on said side and provided with the recess S and which roughly in the central region projects downwards over the ground line T—T with a projection t and is bounded in the longitudinal direction roughly by the two lines 110', 110". It is also possible to see the profile part 112 located on the other side of the tread surface and represented by the broken line.

Figure 12:
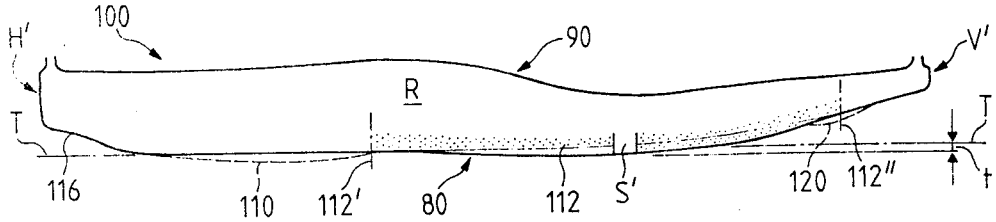
FIG. 12 illustrates the outsole shown in perspective view according to arrow direction W, in FIG. 10.

FIG. 12 shows in a view in accordance with arrow direction W (FIG. 10) the sole inside R of outsole 100 and it is possible to see the bearing surface 90, tread surface 80, heel bevel 116, the profile part 112 located on this side and provided with recess S' and which roughly in the central region projects downwards over the ground line T—T with a projection t' and is longitudinally bounded roughly by the two lines 112', 112". It is also possible to see the other profile part 110 represented by means of broken lines, as well as the support part 120.

As is diagrammatically shown in FIGS. 11 and 12, the two profile parts 110 and 112 are substantially arcuate and which in the centre project over the ground line T1—T with a projection designated to or t' and at the ends designated by lines 110', 110" and 112', 112" are shaped in uniform manner onto the tread surface 80. As shown in FIGS. 11 and 12, the two profile parts 110, 112 can be subdivided by a gap S or S' into two portions or by several gaps into several portions (not shown). In a not shown variant the profile parts 110, 112 can also be constructed as through webs.

Figure 13:
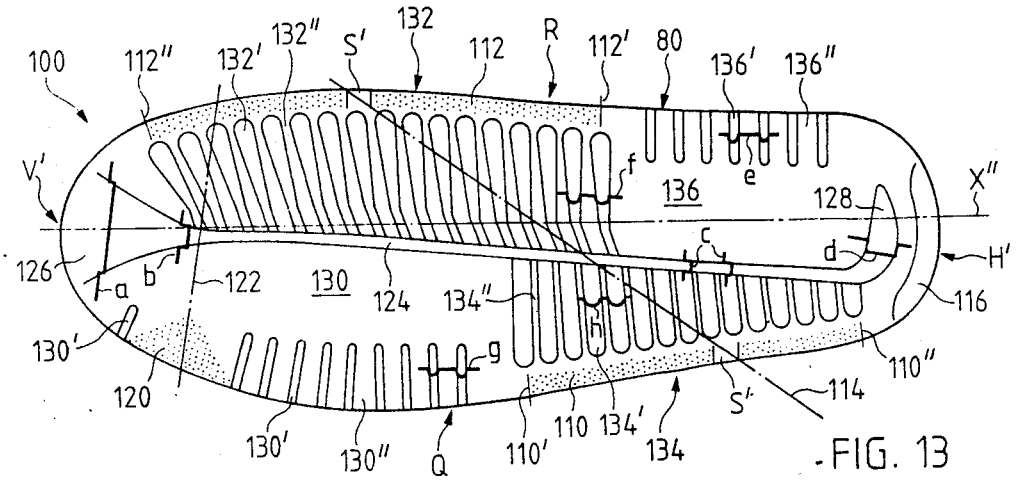
FIG. 13 is a plan view of a constructional variant of the tread surface for the outsole facing the ground.

FIG. 13 shows the further, preferred embodiment of the tread surface 80 and it is possible to see the recess 124 extending roughly from the front edge V' to the rear edge H' with the fork-like opening 126 provided in the vicinity of front edge V' and the recess 128 located in the vicinity of the heel bevel 116 and the rear edge H'. The individual support regions 130, 132, 134 and 136 are in each case provided with a profile system constituted by channels or recesses (incisions) and webs and arranged on either side of the longitudinal axis X".

Support region 130 has a plurality of substantially parallel channels 130', and webs 130" directed from the sole outside Q to the longitudinal axis X", whereby with respect to the longitudinal axis X" said channels and webs extend roughly to the center of support region 130. Preferably a further channel 130' is provided upstream of the support part 120 in the vicinity of leading edge V'.

Support region 134 has a plurality of substantially parallel channels 134' and webs 134" extending from the first profile part 110 to recess 124 and issuing into the latter. In uniformly distributed manner, said channels and webs extend substantially over the entire length of the profile part 110 bounded by edges 110' and 110".

Support region 136 has several substantially parallel channels 136' and webs 136" directed from the sole inside R to the longitudinal axis X", said channels and webs being arranged approximately at right angles and in spaced manner with respect to the longitudinal axis X" on the tread surface 80 and considered at right angles to longitudinal axis X" extend roughly up to the centre of support region 136.

Support region 132 has a plurality of substantially parallel channels 132' and webs 132" extending from the second profile part 112 to recess 124 and issuing into the latter. In uniformly distributed manner, these channels and webs extend substantially over the entire length of the profile part 112 bounded by edges 112' and 112".

The webs 130" and 136" formed between the recesses or channels 130' and 136' of the two support regions 130 and 136 are wider and preferably twice as wide as the associated channels 130', 136'. The webs 132" and 134" formed between the recesses or channels 132' and 134' of the two other support regions are significantly narrower than the associated channels 132', 134'. In the support region 132, the portions of the channels 132' and webs 132" issuing into recess 124 which are oriented approximately at right angles to the longitudinal axis X" and extend over the latter, are constructed in preferably bent manner in the direction of rear edge H', as shown in FIG. 13.

The channels and webs arranged in the previously described support regions 130, 132, 134 and 136 are positioned substantially at right angles to the longitudinal axis X", the channels 132', 1324' and webs 132", 134" arranged in the vicinity of the profile parts 110 and 112 are constructed in such a way that the outsole 100 is flexible and slip-resistant and also the specific loads acting on the particular regions of the not shown foot and which gradually increase on contact with the ground, particularly when walking, are the damped.

The thicker lines in FIG. 13 represent the profile cross-sections of the individual elements arranged on the tread surface 80, whereby the individual points a,b, c and d essentially represent the profile of recess 124, e the profile of channels 136, and Webs 136' in support region 136, f the profile of channels 132' and Webs 132" in support region 132, g the profile of channels 130' and webs 130" in support region 130 and h the profile of channels 134' and webs 134" in support region 134.

The remaining surfaces of the two support regions 130, 136, i.e. those located outside channels 130' and webs 130", as well as channels 136 and webs 136" positioned between recess 124 and the particular channels and webs are preferably constructed in the form of a planar surface.

The support regions 132, 134 separated from one another by recess 124 with channels 132', 134' and webs 132", 134" on the one hand and support regions 130, 136 with channels 130', 136' and webs 130", 136" on the other are, as shown in FIG. 13, arranged substantially diagonally to one another on the tread surface 80 of outsole 100.

The above-described insole 10, 40 according to FIGS. 2 to 9, as well as the outsole 100 according to FIGS. 10 to 13 are e.g. made from a suitable plastic or similar material by moulding. The insole 10, 40 can be individually inserted in a shoe or boot (also subsequently) or forms a standard unit with the outsole 100.

What is claimed is:

1. A sole arrangement for footwear comprising:

a longitudinally elongated insole for providing a natural support for the human foot, said insole having an upper surface adapted to be engaged by a foot and a lower bearing surface having a support system with a plurality of webs and channels; and a longitudinally elongated outsole having an upper bearing surface engaging the lower bearing surface of the insole, said outsole having a lower tread surface which will face the ground when the outsole is in use, the outsole tread surface having front and rear edges, first and second opposite sides, the first side being designated as inside, the second side being designated as outside, and a toe region adjacent the front edge;

the outside having a first part with a web-like profile disposed intermediate the front and rear edges and a flat support part arranged on the toe region and spaced from the first part, the first part being spaced from the rear edge and extending longitudinally along the outside to at least to the center of the outsole;

the inside having a second part with a web-like profile disposed intermediate the front and rear edges, the second part being spaced from the front edge and extending longitudinally along the inside to at least the center of the outsole.

2. Sole arrangement according to claim 1 herein the support system of sole is located approximately in the central or metatarsal region and comprises a plurality of webs oriented at right angles to a longitudinal axis and substantially parallel to one another, and channels.

3. Sole arrangement according to claim 1 wherein the tread surface of outsole has individual support regions essentially subdivided by a longitudinally oriented recess whereby some support regions are arranged approximately diagonally to one another and associated with the first and second profile parts are provided with channels oriented at right angles to the longitudinal axis (X″) and extending from recess to said profile parts as well as webs and the two other support regions arranged diagonally to one another are also provided with channels oriented at right angles to the longitudinal axis and extending approximately up to the centre of the particular support region, and to the webs.

4. Sole arrangement according to claim 2, wherein the support system comprising webs and channels extend substantially at right angles to longitudinal axis over the entire width of the central or metatarsal region of insole and that in each case one channel oriented approximately parallel to the longitudinal axis and is associated with the two outer channels of the particular support system.

5. Sole arrangement according to claim 1, wherein in the support ball region on the side facing the outsole, the insole has a pocket in which are arranged at least two cams at right angles to the longitudinal axis.

6. Sole arrangement according to claim 1, wherein in the support ball region and in the tarsal region, the insole has in each case a flat support element, said support elements have a correspondingly constructed surface to prevent slippage when the insole is used as an insert sole.

7. Sole arrangement according to claim 1, wherein on the outside, in the tarsal region of insole on the rear edge and laterally spaced with respect thereto are provided slot-like channels oriented approximately vertically to the longitudinal axis.

8. Sole arrangement according to claim 1, wherein on a foot bed wall on the sole inside, the insole has a plurality of slot-like channels, which are preferably associated with the channels of the individual support system.

9. Sole arrangement according to claim 1, wherein holes are provided in spaced manner from one another in the tarsal region of the insole and provide a connection from the outside to foot bed.

10. Sole arrangement according to claim 1, wherein the two profile parts of the outsole have in profile cross-section a convex shape oriented towards the ground and in the longitudinal direction an approximately arcuate shape, the individual profile part, considered in the longitudinal direction, being provided roughly in the centre with a projection projecting over the ground line.

11. Sole arrangement according to claim 1, wherein each individual profile part is continuous or is subdivided into portions by at least one recess, the recess being so arranged in the particular profile part that a theoretical line interconnecting the recesses forms an axis of the subtalar coordinated movement of the human foot.

12. Sole arrangement according to claim 3, wherein a recess provided on the tread surface and oriented in the longitudinal direction forms an acute angle with respect to the longitudinal axis and is positioned between the longitudinal axis and the sole outside.

13. Sole arrangement according to claim 3, wherein a recess is constructed in the front region of the tread surface as a fork-like opening and issues into a recess in the rear region and which is positioned roughly parallel to a heel bevel.

14. Sole arrangement according to claim 1, wherein the insole as well as the outsole are made from a suitable foamed plastic or the like and can be produced by moulding or some similar process.

15. Sole arrangement according to claim 1, wherein the insole is constructed with the outsole as a standard unit.

* * * * *

UNITED STATES PATENT AND TRADEMARK OFFICE

CERTIFICATE OF CORRECTION

PATENT NO. : 4,852,273

DATED : August 1, 1989

INVENTOR(S) : Norbert Hamy

It is certified that error appears in the above-identified patent and that said Letters Patent is hereby corrected as shown below:

On the title page, item [54] and in column 1, line 2, "Sole Arrangement for Footware" should be --Sole Arrangement for Footwear--.

Signed and Sealed this

Fourth Day of February, 1992

*Attest:*

HARRY F. MANBECK, JR.

*Attesting Officer*

*Commissioner of Patents and Trademarks*